US006283876B1

(12) United States Patent
Northcutt

(10) Patent No.: US 6,283,876 B1
(45) Date of Patent: Sep. 4, 2001

(54) TENNIS TRAINING SYSTEM

(76) Inventor: Michael E. Northcutt, 470 E. Calaveras Blvd., Ste. D-200, Milpitas, CA (US) 95035

( * ) Notice: Subject to any disclaimer, the term of this patent is extended or adjusted under 35 U.S.C. 154(b) by 0 days.

(21) Appl. No.: 09/267,797

(22) Filed: Mar. 12, 1999

(51) Int. Cl.[7] ..... A63B 69/00
(52) U.S. Cl. ..... 473/422; 473/432
(58) Field of Search ..... 473/422, 451, 473/459, 460, 432

(56) References Cited

U.S. PATENT DOCUMENTS 3,677,544 * 7/1972 Meyers et al. ..... 473/451
4,932,657 * 6/1990 Hailer et al. ..... 473/446

* cited by examiner

*Primary Examiner*—Jeanette Chapman
*Assistant Examiner*—M. Chambers
(74) *Attorney, Agent, or Firm*—The Kline Law Firm

(57) ABSTRACT

A ball striking training system that delivers balls to a user's hitting zone without a horizontal velocity component includes a hopper to hold a plurality of balls and a feeding mechanism which delivers tennis balls to an outlet tube where they are dropped from a chosen height so that they bounce to the height desired by the user. The balls may be struck by a learner into a target area that includes a collection mechanism to collect the balls so that they may easily be returned to the hopper of the feeding mechanism. The system can be set up to be used indoors or outside at the user's convenience.

19 Claims, 16 Drawing Sheets

TENNIS TRAINING SYSTEM

FIELD OF THE INVENTION

The present invention relates generally to ball striking training systems and more particularly is a device to deliver tennis balls and baseballs to a player in a manner that eliminates horizontal velocity, such that the balls move only in a vertical plane when they are in the player's striking zone. The device also includes a target means and a means to retrieve the balls. The receiving unit is adapted to receive golf balls as well as tennis balls and baseballs.

BACKGROUND OF THE INVENTION

Tennis, baseball, and golf are games in which players can greatly improve their skills by repetitive stroke production. In order to maximize the value of stroke repetition in tennis, a consistent ball delivery means is required. Simply hitting with a partner provides a player with the opportunity to strike the ball many times. However, since the delivery means in this instance is simply another player who is also practicing his strokes, the balls may be delivered to an unlimited number of locations and with varying speeds and trajectories. While this does not present a problem for the advanced player, it can be very difficult for beginners to efficiently practice with other beginners. If a beginner can master stroke production first, the other variables will be much easier to learn.

One method to improve tennis practice efficiency for beginners is to have one player "feed" balls to another player. The first player simply takes balls from a container and throws or strikes the balls to an area from which the second player wishes to stroke the ball. This method increases the efficiency of the session for the second player. Unfortunately, the first player gets little or no benefit or enjoyment. It is a difficult task to deliver balls to the same spot consistently. This method can be costly as well since professionals are usually required for this task.

The prior art includes a large number of ball throwing machines that deliver balls to a target area for a player. These machines typically utilize a pair of wheels spinning in opposite directions to propel a tennis ball or baseball out of a staging area. There are a number of methods designed to allow the user to vary the trajectory, speed, and frequency of the ball feed. The control methods range from simple manual controls to computer operated remote controls.

However, without exception, all the prior art machines propel the balls outward with a horizontal velocity component. For an absolute beginner, striking a ball moving with considerable horizontal velocity is difficult.

Similar problems of consistent delivery occur in baseball. Again, a human pitcher or a ball machine that propels balls toward a hitter are fine for advanced players, but true beginners need a delivery means that removes at least the horizontal motion component. Many baseball hitters address the problem by using a batting tee, but manually positioning the ball for each swing grows tiring quickly. An initial coordination training could be obtained if the ball were dropped slowly through a short path of a couple of feet or so.

Another problem inherent in ball throwing machines is weather. Horizontal velocity precludes practice in one's garage as there is not sufficient reaction time within the distance available. A vertically dropped ball avoids this problem. Thus, one can practice all year long in their garage without the need for expensive indoor training facilities.

Another problem common in tennis, baseball, and golf practice is retrieving the balls. When a player is hitting off of a machine or with another person feeding him balls, there are a great many balls to be recovered after a very short amount of practice time. This reduces the efficiency of the players practice session due to the necessity of spending a considerable percentage of valuable practice time solely retrieving balls.

An inherent problem in retrieving balls when a retrieving net is used is the size of the receiving net. Nets which are supported from a base are limited in size by their nature. To be practical, their components must be compatible with a car door or trunk and small enough to be light weight. Usefulness of such a device would be very limited if their size was so great that trucking or expensive setup was required.

Another inherent problem for children and beginners is that small nets are hard for children and beginners to hit. Many balls will go over or around such nets. In the case of golf, this could be inherently dangerous.

Some receiving nets have been designed with large ball collectors on their front surface. In such a design many balls will hit the collector rather than be received by it.

Accordingly, it is an object of the present invention to provide a ball machine that consistently delivers balls to a user.

It is a further object of the present invention to eliminate the horizontal component of the ball's velocity. A ball that is delivered with only a vertical velocity will at one point in its travel path be motionless. This point occurs when the ball reaches its peak following a bounce on a surface.

A further object of the invention is to provide a ball delivery system which because of the lack of a horizontal velocity component can be used in limited space such as a garage.

A further object of the invention is to provide a system compatible with indoor use, thus being weatherproof.

A further advantage of the present invention is that because the system is garage compatible, practice may occur after dark without the need for elaborate lighting. Even advanced players may benefit by hitting balls after work.

It is a further object of the present invention to provide a system that includes a ball collection and retrieval system.

A further object of the invention is to provide a target/collection net which may be hung from garage door support rails, a cyclone fence, or another existing structure, thus increasing support and accommodating large nets without unwieldy support setup structures.

A further object of the invention is to provide clamps facilitating garage door net support and at the same time allowing for rapid net retraction.

A further object of the invention is to provide a net and trough system optimally designed for maximizing frontal hitting surface with minimal collector interference.

A further object of the invention is to provide a machine which may be used for both baseball and tennis. Current machines, because of the enormous force differential between baseballs and tennis balls, are all suited for only one or the other.

A further object of the invention is to provide an inherently simple system wherein golf may be practiced in one's garage.

SUMMARY OF THE INVENTION

The present invention is a ball delivery machine that delivers balls without a horizontal velocity component. The device includes a hopper to hold a plurality of balls and a feeding mechanism which delivers tennis balls to an outlet tube where they are dropped from a chosen height so that they bounce to the height desired by the user. The balls may be struck by a learner into a target area that includes a funneling means to collect the balls so that they may easily be returned to the hopper of the delivery device. The device can be set up to be used indoors or outside at the user's convenience.

An advantage of the present invention is that it enables a user to efficiently practice his strokes due to the machine's consistently delivering the balls to a single location.

Another advantage of the present invention is that it automatically gathers the balls so that they can be returned to the hopper of the machine.

A still further advantage of the present invention is that it can be used in an indoor location such as a garage. Thus, anyone with a garage can practice during inclement weather. Horizontally propelling ball machines necessitate a velocity incompatible with the short confines of a garage.

A further advantage of the device is that it may be used to slowly drop baseballs so they may be hit without an incoming velocity.

A further object of the present invention is that it provides a support and clamping device for the tubing of this invention such that the vertical and horizontal components to carry balls may be adjusted to fit existing ball machines.

A further advantage of the present invention is that it provides one machine which may be used for baseball, tennis, and golf.

A further advantage of the invention is that the device may include a protective netting which is hung from garage door rails to allow golf practice in one's garage without the danger of ricocheting balls.

A further advantage of the present invention is that it allows similar security and collection for outdoor golf practice.

A further advantage of the present invention is that it utilizes a receiving net larger that what could be reasonably accomplished by a free standing net by utilizing pre-existing support structures such as garage door rails, garage rafters, and cyclone fences.

A further advantage of the invention is that it facilitates sports training in schools by eliminating the need for more tennis courts, baseball diamonds, and golf areas.

DETAILED DESCRIPTION OF THE INVENTION

The present invention is a ball delivery and collection system that is capable of delivering balls to a user's hitting zone without a horizontal velocity component. The device includes a target/collection means 10 that provides a method of retrieving the balls after they have been hit. The system further comprises a ball delivery means 20. The ball delivery means 20 comprises a feeding system used in conjunction with a delivery tube to provide the proper presentation of the balls. The outlet means for feeding the balls to the delivery tube can be one of any number of means known in the art to deliver a ball from a canister. In the preferred embodiments, it is envisioned that the feeding system will typically be operated by air pressure, auger means, or a rotor.

Figure 1:
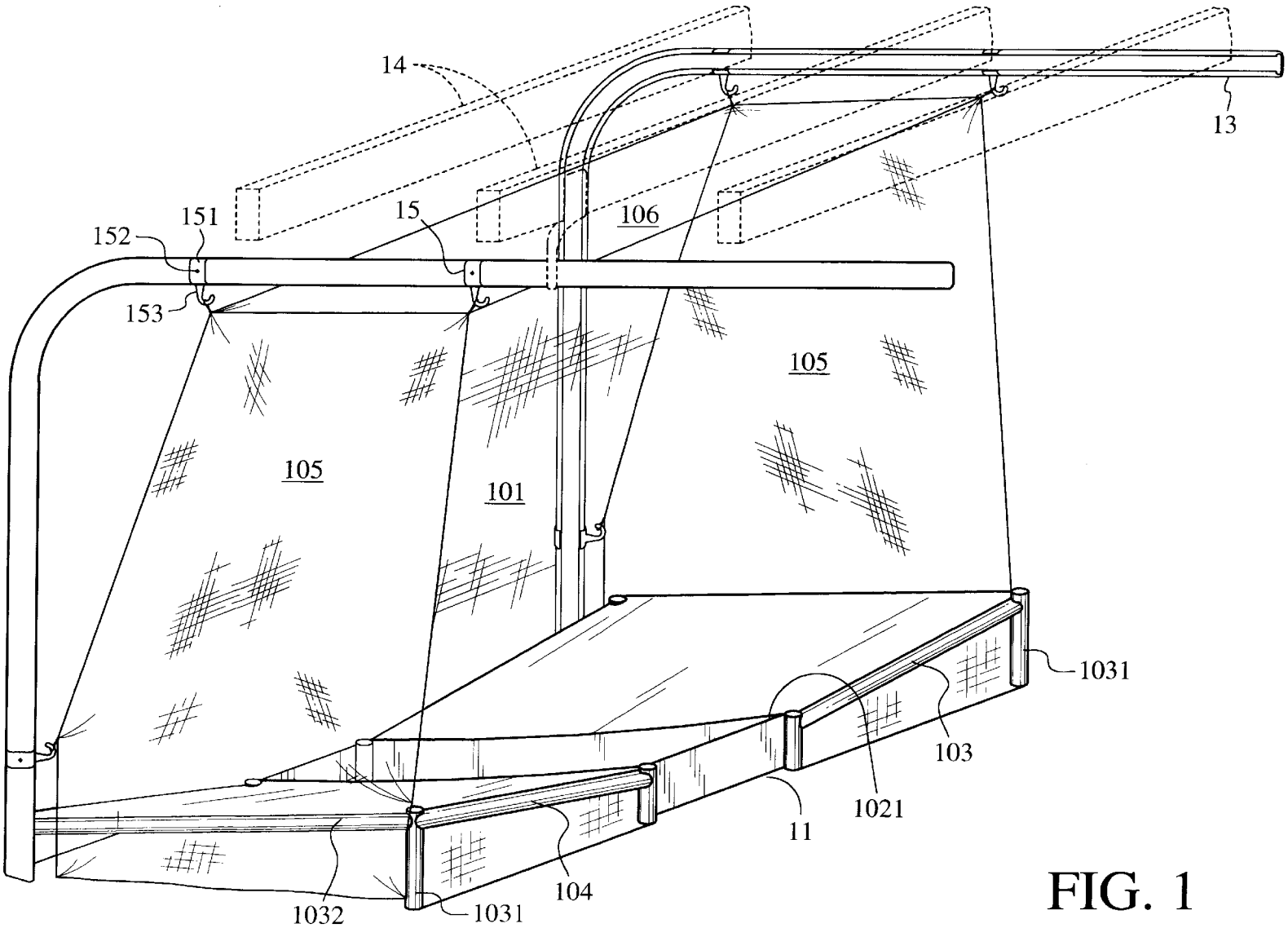
FIG. 1 is a perspective view of the target/collection means of the ball training system of the present invention.

Referring first to FIG. 1, the ball training system of the present invention comprises a target/collection means 10. The target/collection means 10 includes a large backdrop 101 with a collection trough 102 positioned at the bottom of the backdrop 101. The backdrop 101 is detachable from the receiving trough 102 in order to allow automatic retraction of the backdrop and side walls (described below). The backdrop 101 must be made of a material flexible enough to absorb shock from the balls so that the balls do not rebound past the collection trough 102. It is envisioned that in the preferred embodiment for tennis, the backdrop will be made of a netting material, while in the preferred embodiments for baseball and golf, the backdrop may be formed from a stiffer material, such as canvas or the like. It is understood that various materials can be used for the side walls and backdrops of the present invention without departing from the spirit and scope of the invention.

The target/collection means 10 includes a support mechanism 103 for the collection trough 102. A front lip 104, which generally will be constructed as part of the support mechanism 103, inhibits balls from rolling over the front of the trough 102. The support mechanism 103 is simply a means to secure the collection trough 102 in the proper position relative to the backdrop 101. In the preferred embodiment, the support mechanism 103 comprises a plurality of legs 1031 situated at the corners of the collection trough 102. The legs 1031 are joined by transverse connecting bars 1032.

The backdrop 101 is positioned at an angle of less than 90° relative to the collection trough 102. That is, the backdrop 101 is angled forward relative to the front face of the collection trough 102 so that balls that strike the backdrop 101 are directed downward into the collection trough 102 as is shown schematically in FIG. 8. This allows the system of the present invention to utilize a much narrower collection trough 102 than would be possible with a vertical backdrop. The target/retrieval means 10 includes side panels 105 and a top panel 106 to ensure that the balls are directed into the collection trough 102.

The collection trough 102 of the target/collection means 10 includes a gap 1021 therein. The collection trough 102 is angled downward from both ends toward the middle so that the balls will be directed by gravity toward the gap 1021. A collection bucket or box 11 is positioned beneath the gap 1021 to receive the balls as they roll down the collection trough 102 and fall through the gap 1021.

Figure 2:
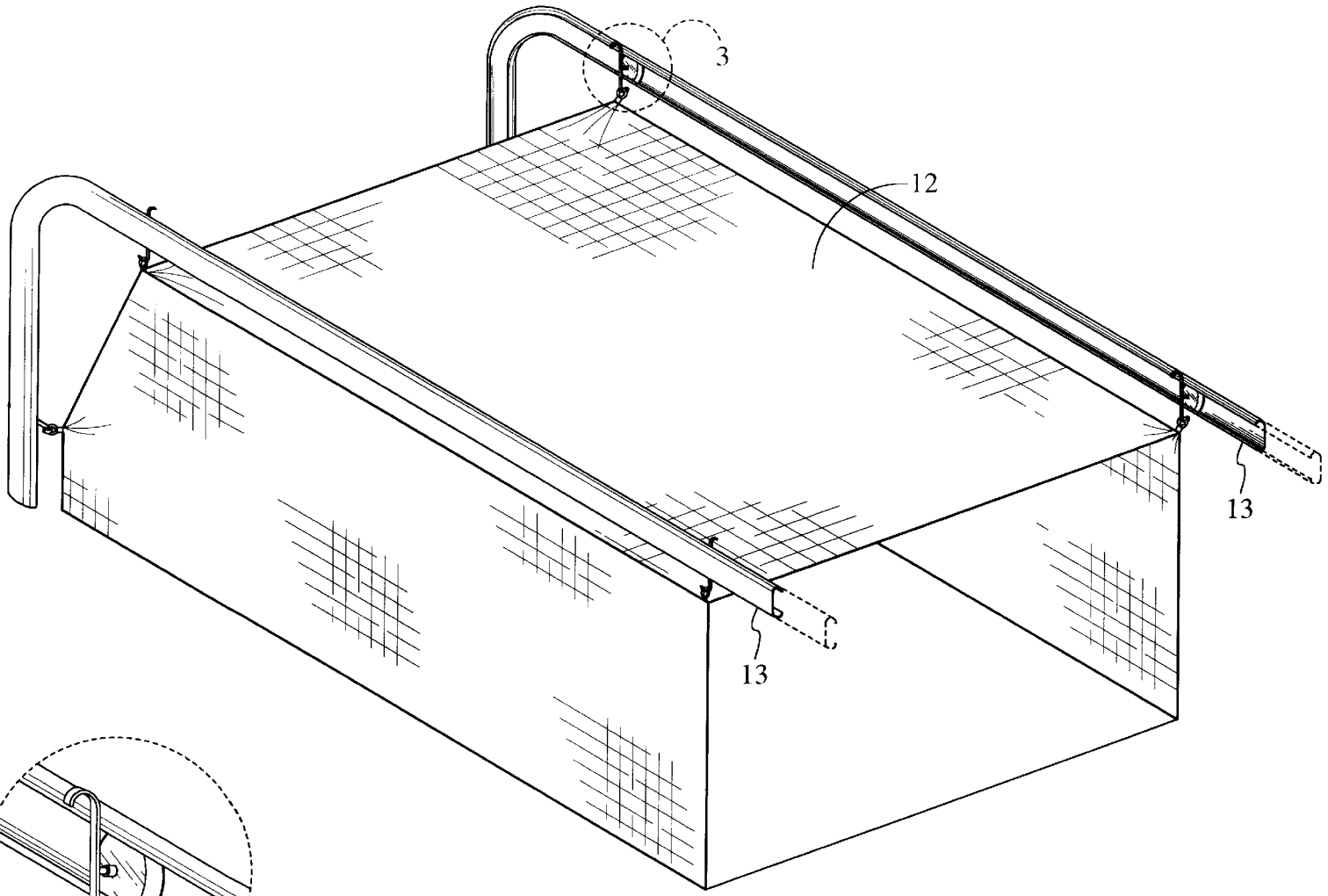
FIG. 2 is a perspective view of an enclosure installation of the present invention.
Figure 2A:
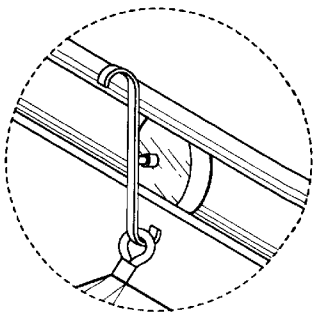
FIG. 2*a* is a detail view of the area circled and labelled "2*a*" in FIG. 2 showing an attachment means to secure the target/collection means of the device to a garage door rail.

FIG. 2 illustrates an enclosure 12 that can be used as a component of the device of the present invention. The enclosure 12 is closed on at least three sides and the top. With the enclosure 12 in place, a user can stand inside the enclosure 12 to hit balls, and the balls will be stopped by the enclosure 12 regardless of their path. It is envisioned that the walls of the enclosure 12 will be formed from a netting material in the preferred embodiment. The enclosure 12 is most likely to be used with the embodiments adapted for golf or baseball.

It is further envisioned that one of the chief uses of the system of the present invention is for in-home use in the garage. Accordingly, the target/retrieval means 10 and the enclosure 12 are adapted to be mounted from a user's garage door rails 13 or the rafters 14 of the garage. Securing hooks 15 adapted to fit on garage door rails 13 can be used to mount the target/retrieval means 10 and the enclosure 12. The hooks 15 include a main body 151 shaped to conform to the shape of the rails 13, and are secured to the rails by a set screw 152. The main body 151 includes a hook element 153 that secures the target/retrieval means 10 to the hook 15. The position of a rearmost hook 15 on the horizontal portion of the garage door rail 13 can be adjusted to control the angle of the rear panel of the target/retrieval means 10.

Figure 3:
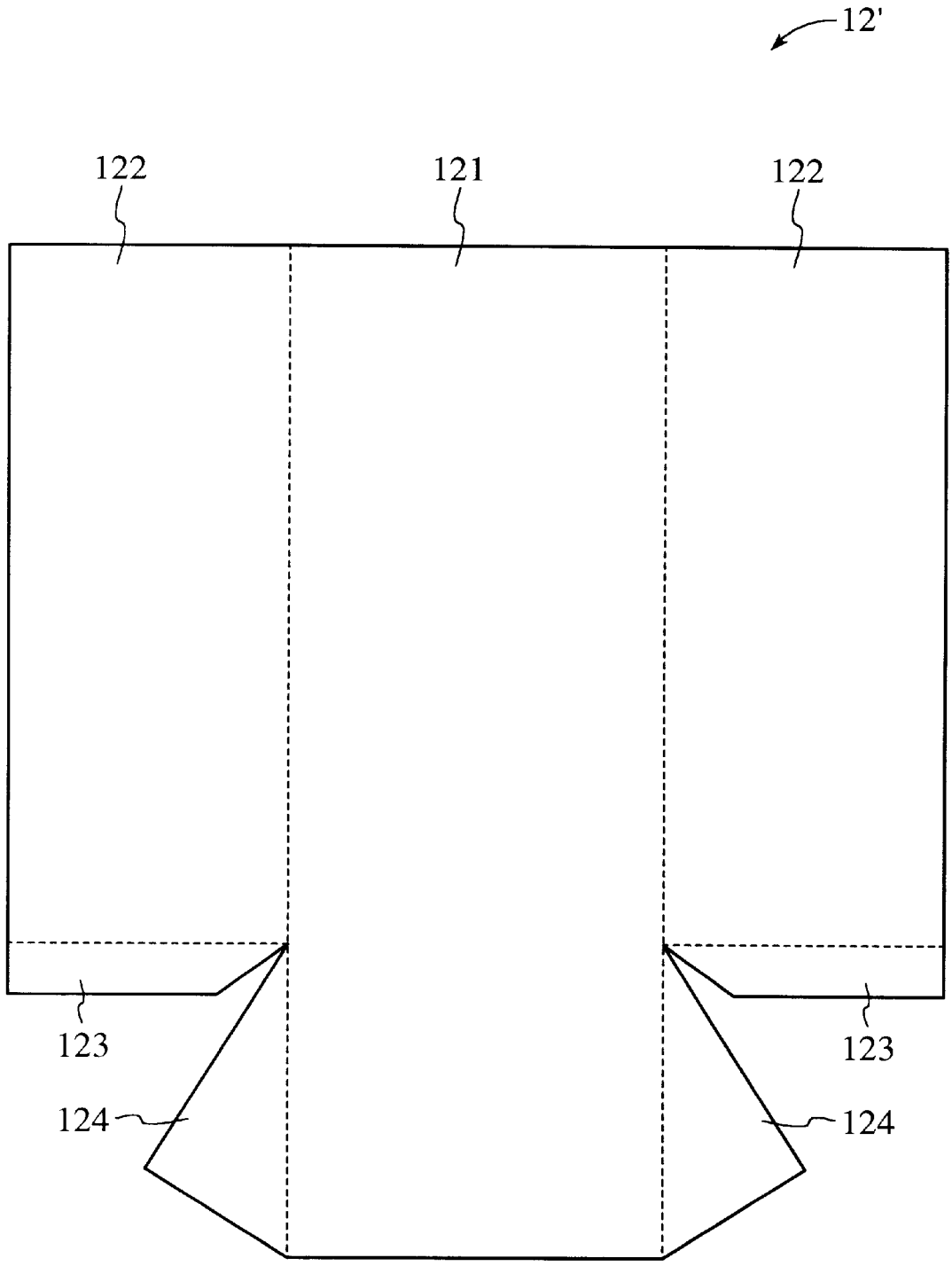
FIG. 3 is a top view of the enclosure constructed from a single netting piece.

FIG. 3 shows an embodiment of the enclosure 12' that is formed with the netting sections all contained in a single element. A central portion 121 of the enclosure 12' is adapted to be draped over garage door rails. With the central portion 121 draped over the rails, the side portions 122 extend downward to form the side walls of the enclosure 12'. When the enclosure is installed, connecting flaps 123 of the side portions 122 are attached to wing elements 124 of the rear portion 125. Any known means of attaching the side portions 122 to the wing elements 124 will suffice, but in the preferred embodiment, Velcro will be utilized. Attachment is necessary so that gaps are not left through which balls can pass.

Figure 8:
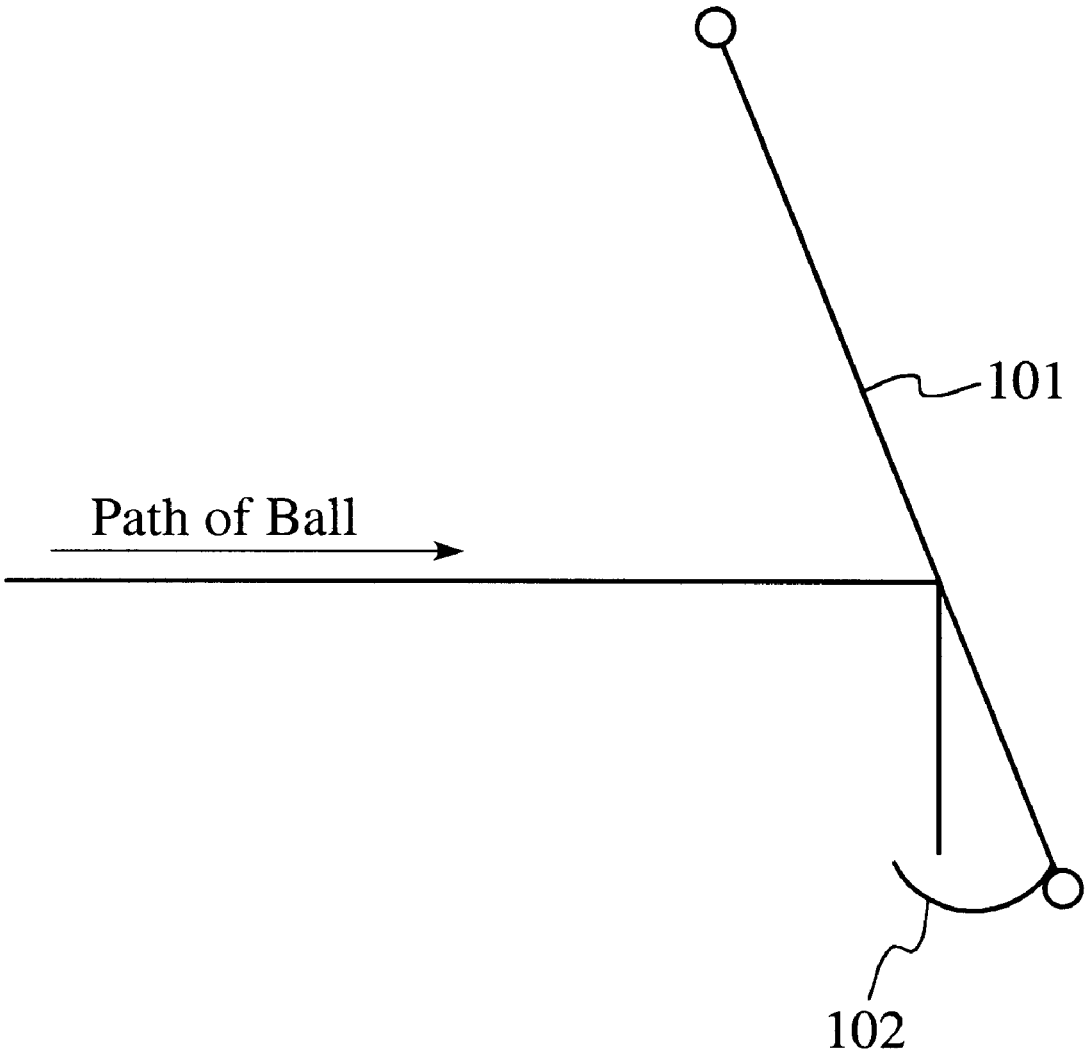
FIG. 8 is a schematic view depicting the function of the angled rear wall of the target/collection means.

The wing elements 124 of the rear portion 125 are angled so that when the enclosure 12' is installed, the rear portion 125 extends downward at a less than 90° angle from the central portion 121. This provides the enclosure 12' with the same configuration as the enclosure 12 illustrated in FIG. 2. The rear portion 125 is angled so that balls are deflected downward when they strike the rear portion 125 as is illustrated in FIG. 8. In practice, it is envisioned that the rear portion 125 can be attached directly to a garage door. The enclosure 12' will then be raised out of the way when the garage door is opened. When the garage door is closed, the rear portion 125 will be pulled taut, and the enclosure 12' will be in the correct configuration.

Figure 4:
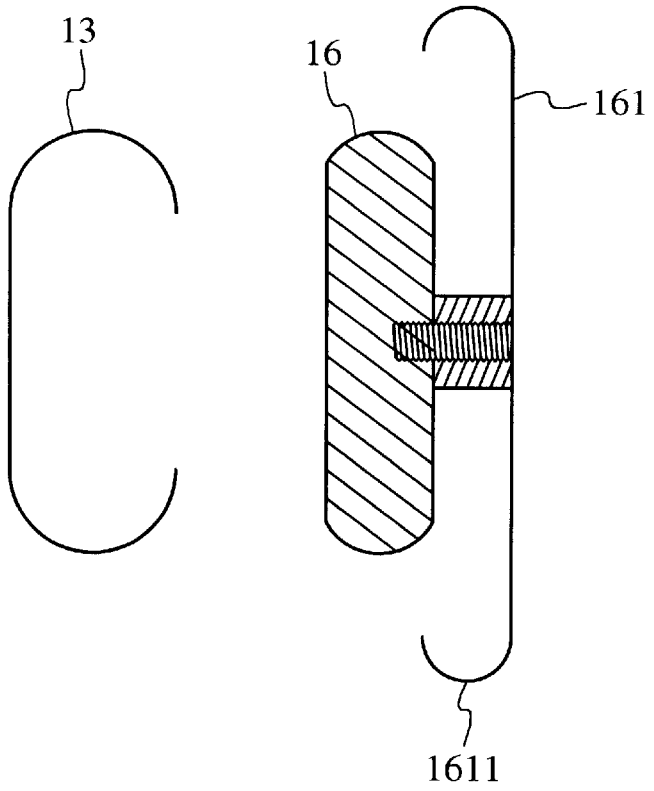
FIG. 4 is a cross section view of the rotatable securing hook and the garage door rail.
Figure 5:
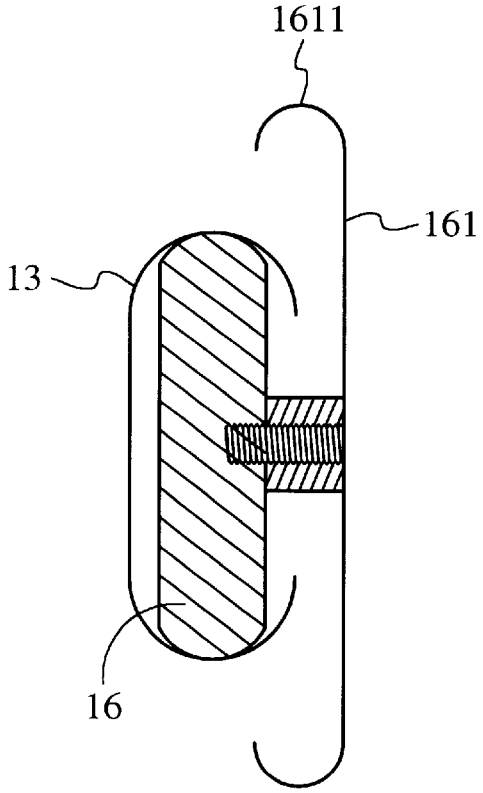
FIG. 5 is a cross section view of the rotatable securing hook installed in the garage door rail.
Figure 6:
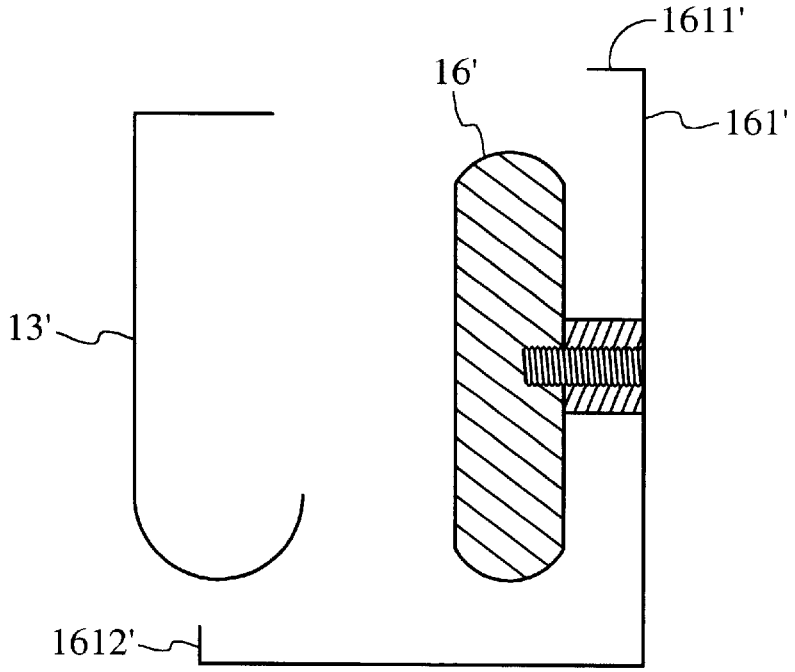
FIG. 6 is a cross section view of a second rotatable securing hook and a second type of garage door rail.
Figure 7:
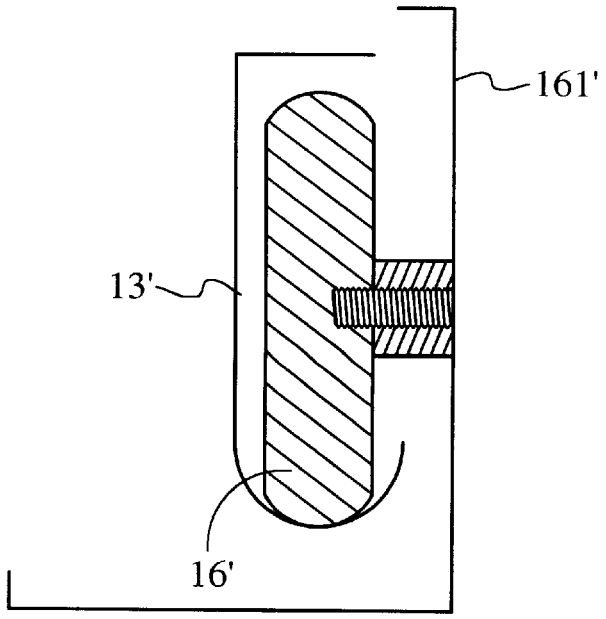
FIG. 7 is a cross section view of the second rotatable securing hook installed in the second garage door rail.

Referring now to FIGS. 4–7, the system can also be adapted so that the target/retrieval means 10 and the enclosure 12 can be automatically retracted. This is accomplished by simply attaching the target/retrieval means 10 and the enclosure 12 to the garage door by means of the modified garage door bearings 16. The bearings 16 are equipped with rotatable securing hooks 161, 161' mounted thereon. The type of hook utilized depends on the particular type of garage door rail. For an enclosed rail as shown in FIGS. 4 and 5, a symmetrical rotating hook 161 with two balanced hook elements 1611 will generally be utilized. For a garage door rail with an open top side as illustrated in FIGS. 6 and 7, the modified hook 161' will be employed. A shorter top hook element 1611' will be used to support the top sections of the backdrop 101 and the enclosure 12. A longer lower hook element 1612' will be used to support the side walls of the backdrop 101 and the enclosure 12. The longer lower hook 1612' serves as a moment arm to counterbalance the tipping force applied to the upper hook element 1611', thereby allowing the bearing 16 to remain positioned in the door rail. In the preferred embodiment, reinforced strips with eyes therein to receive the hooks 161, 161'.

Once the target/retrieval means 10 and the enclosure 12 are connected to the bearings 16, the netting material of the target/retrieval means 10 and the enclosure 12 are retracted when the garage door is opened. The rotation of the hooks 161, 161' allows the netting to be retracted without damage. If the automatic retraction method is used, the collection trough 102 must of course be removed from the device before the retraction operation.

Figure 9:
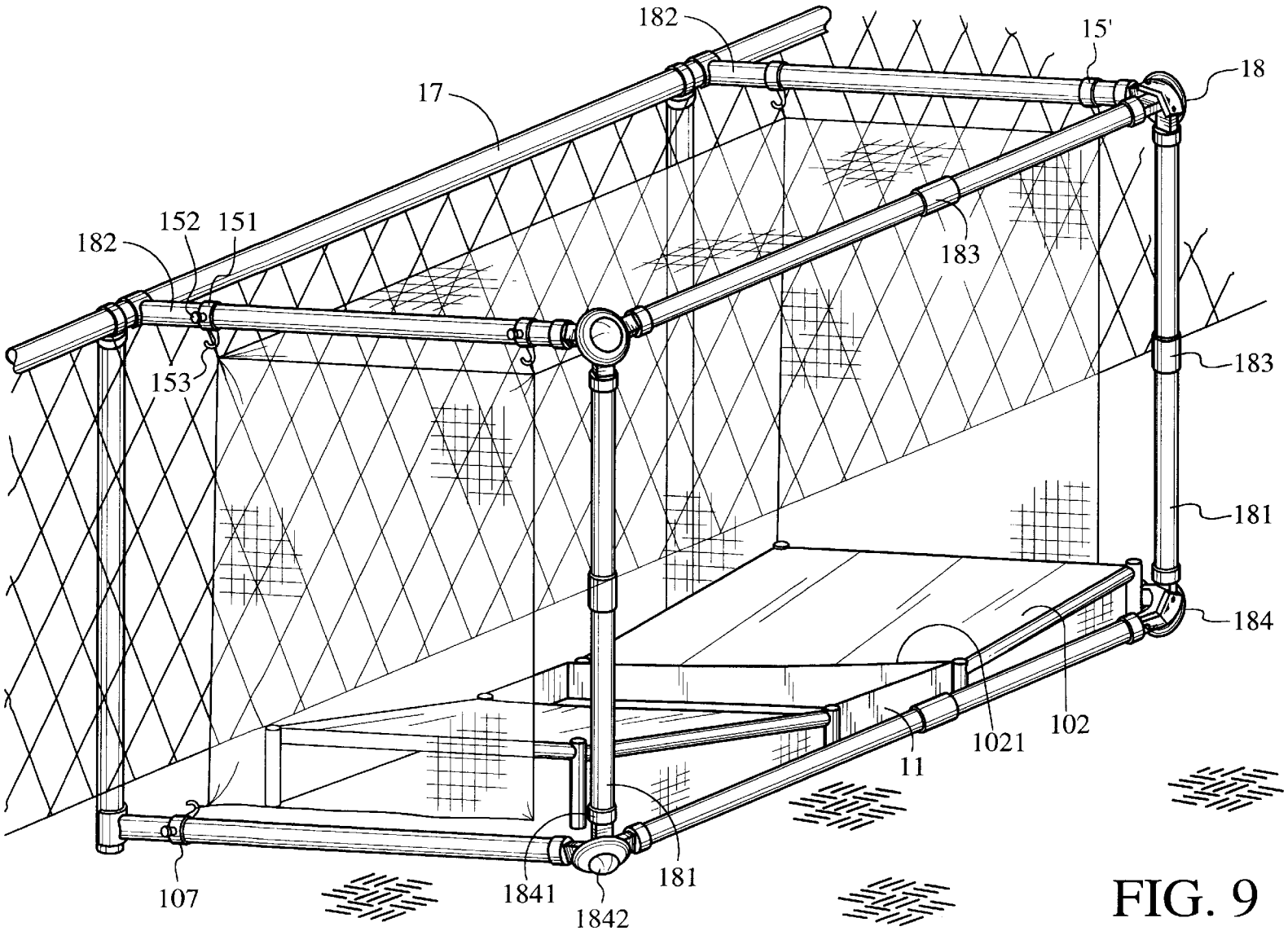
FIG. 9 is a perspective view of the target/collection means of the present invention adapted to be affixed to a fence.
Figure 10:
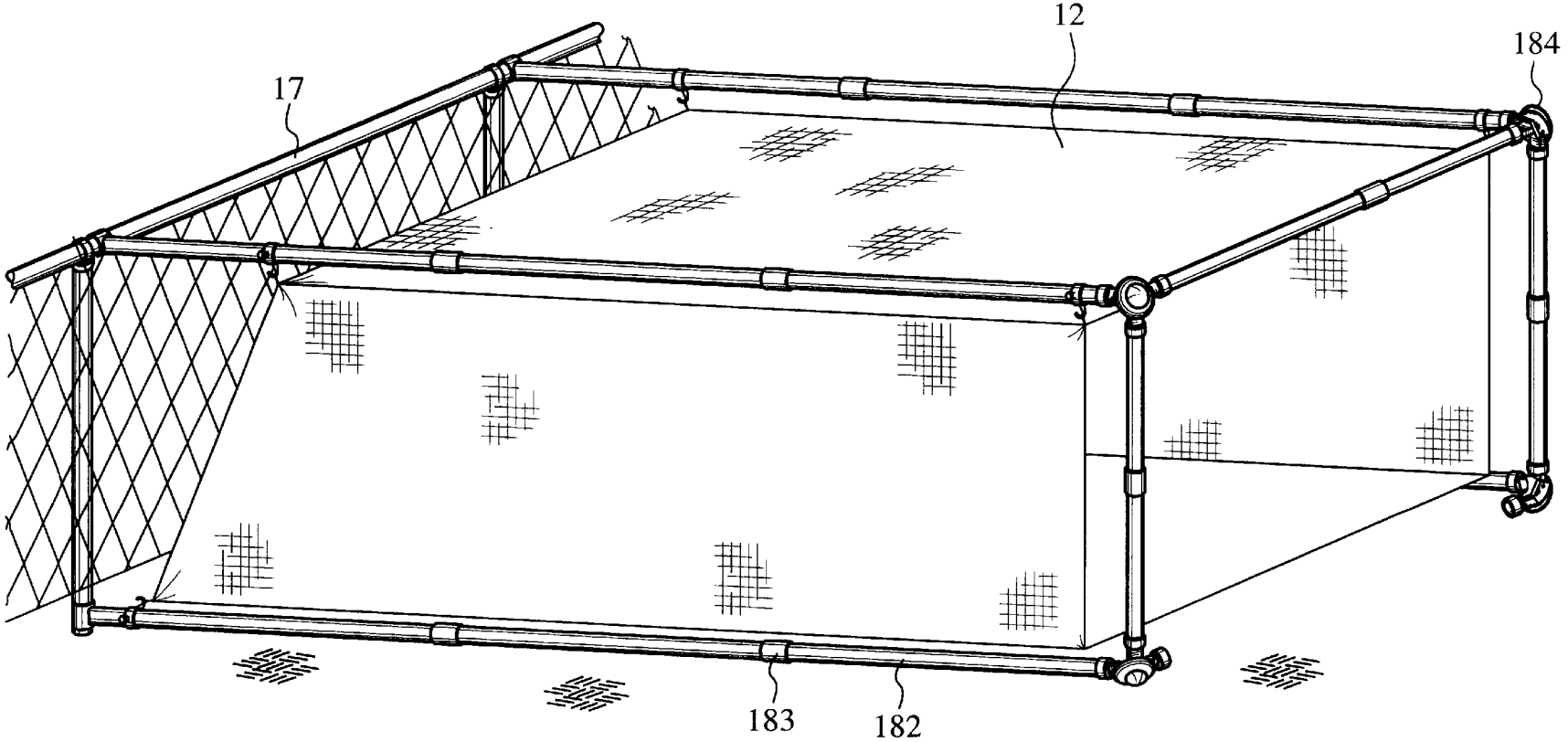
FIG. 10 is a perspective view of the fence-mounted enclosure version of the target/collection means.

An alternative installation method for the target/retrieval means 10 is illustrated in FIGS. 9 and 10. In this configuration, the target/retrieval means 10 is mounted on a fence 17 such as might be found at a park or surrounding a tennis court facility. The installation is accomplished by a fence support means 18. The fence support means 18 comprises both vertical support members 181 and horizontal support members 182 to adequately support the target/retrieval means 10. It is envisioned that the side horizontal members 182 will be attached to posts of the fence 17. The support members 181, 182 may include adjustment joints 183 that allow telescoping segments to be used in the support members 181, 182, thereby enabling the user to adjust the width and height of the fence-mounted target/retrieval means 10.

The corners of the support means 18 that face the user are supported by three-way connectors 184. The connectors 184 can each receive three intersecting support members in sockets 1841. The connectors 184 are situated around a central body 1842 so as to be orthogonal to each other. The central body 1842 of the connectors 184 is rounded so that if a ball strikes the central body 1842, the ball is deflected in a direction other than directly back at the user. This ensures the user that he will not be struck by an errant ball.

The side and top walls of the target/retrieval means 10 and the enclosure 12 are mounted on the fence support means 18 by securing hooks 15'. The hooks 15' are adapted to fit on the members 181, 182 of the support means 18. The hooks 151 include a main body 151' shaped to conform to the shape of the members 181, 182, and are secured by a set screw 152'.

The main body 151' includes a hook element 153' that secures the target/retrieval means 10 to the hook 15'. The position of a rearmost hook 15' on either the upper of lower horizontal support member 182 can be adjusted to control the angle of the rear panel of the target/retrieval means 10.

FIG. 10 illustrates the enclosure 12 adapted for the fence support means 18.

Figure 11:
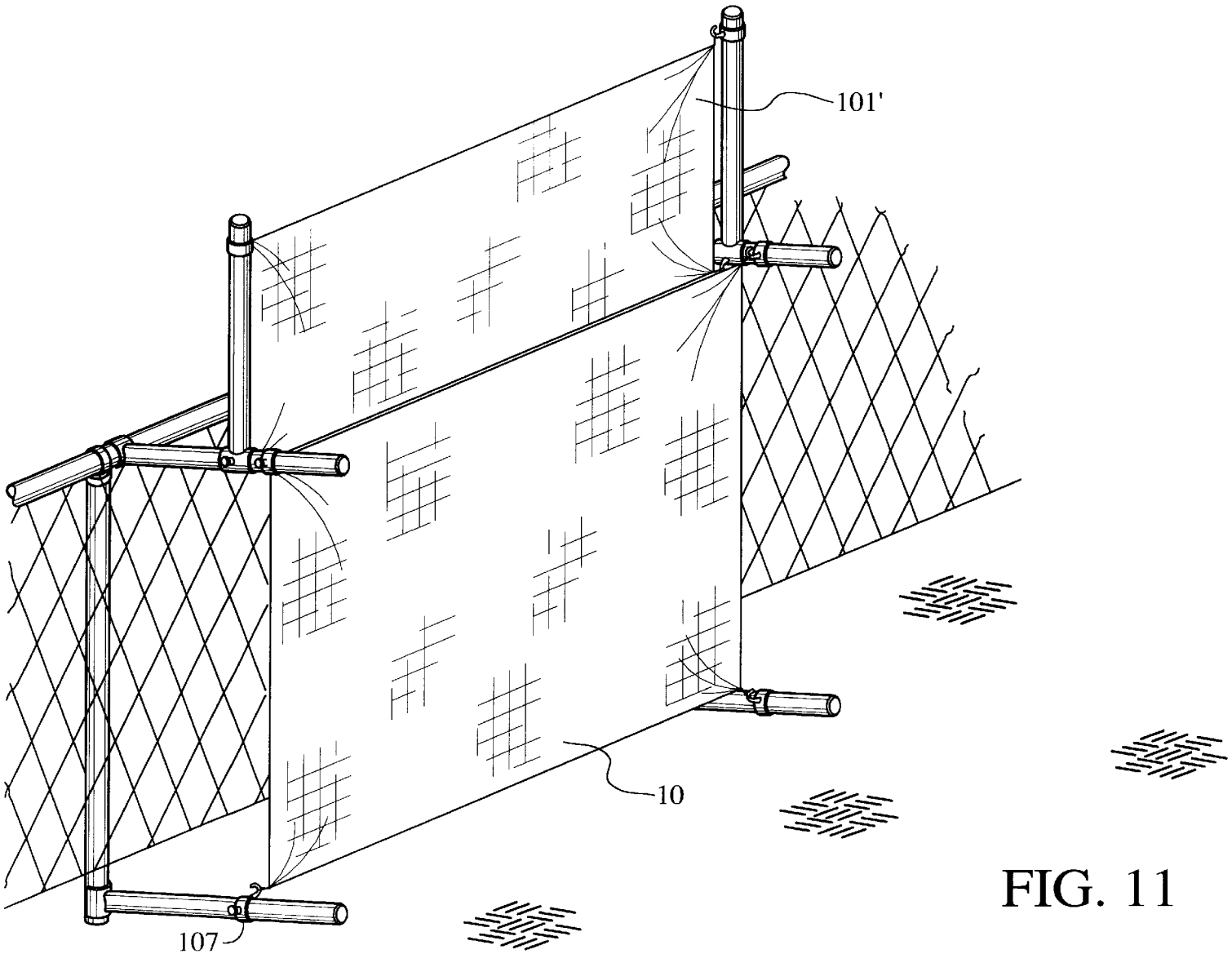
FIG. 11 is a perspective view of a fence-mounted rebound version of the target means of the present invention.

FIG. 11 shows a rebound embodiment 10' of the target/retrieval means 10 mounted on a modified fence support means 18. The support means can be shortened, and the vertical support members 181 eliminated. The rebound embodiment 10' utilizes only a rear panel. The user might desire to increase the area of the target by adding a vertical extension panel 101'. The vertical extension panel 101' is attached to the upper horizontal members 181 directly above the main panel of the rebound embodiment 10'.

Figure 12:
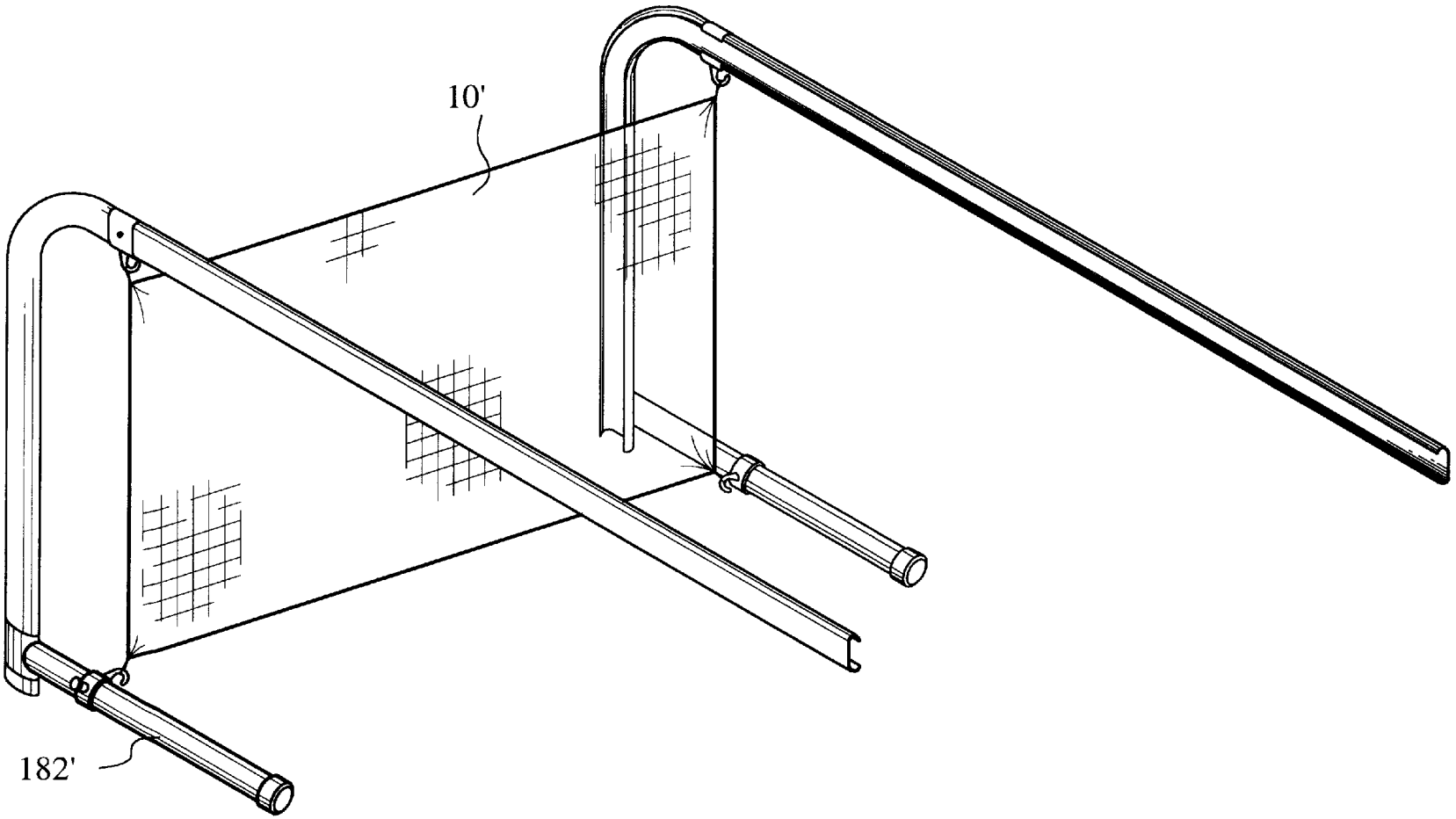
FIG. 12 is a perspective view of a garage door rail-mounted rebound version of the target mean the present invention.
Figure 13:
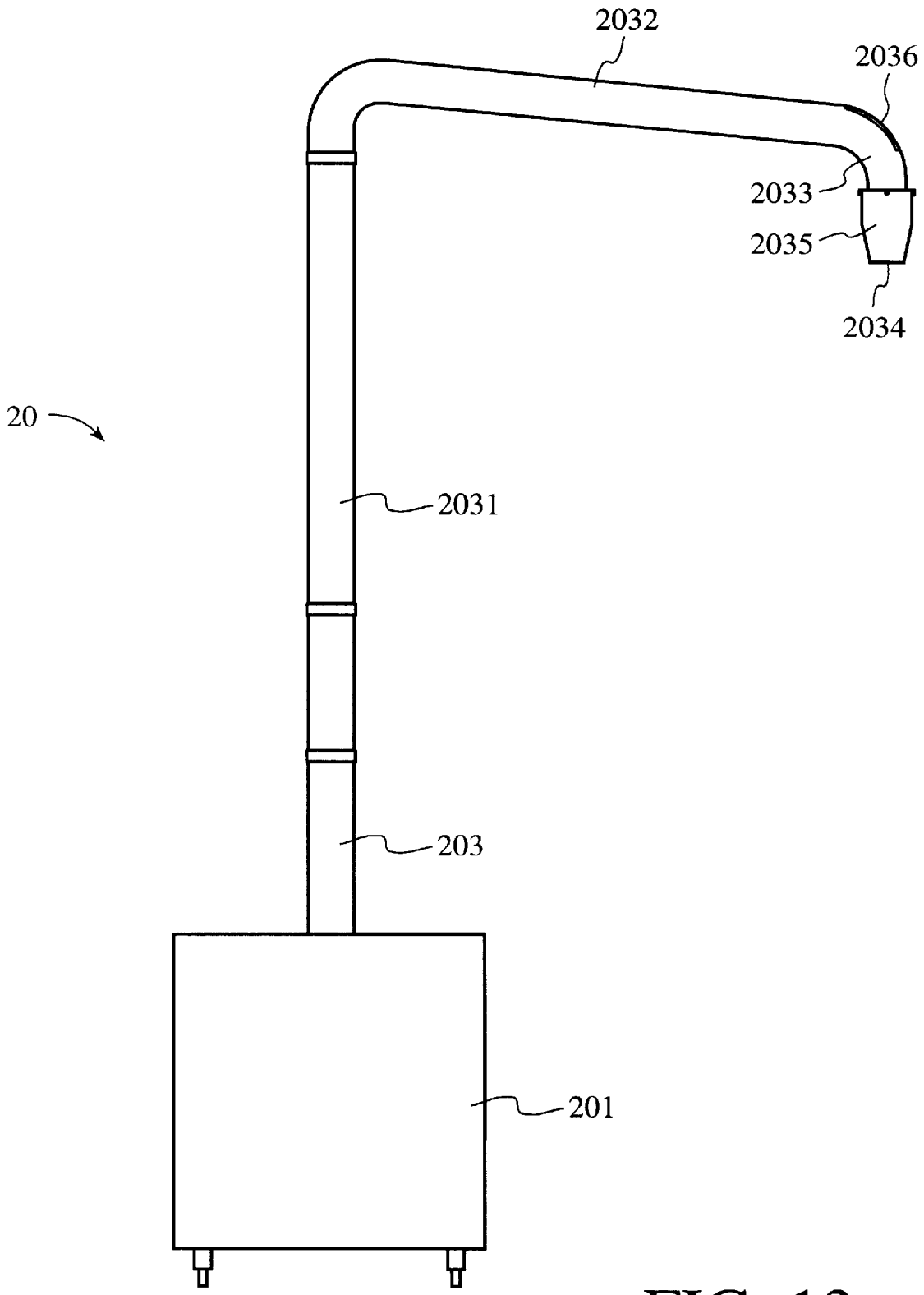
FIG. 13 is a side view of the ball delivery means of the present invention.

FIG. 12 depicts the rebound embodiment 10' adapted to be secured on garage door rails 13. In this embodiment, modified horizontal support members 182' are affixed directly to the garage door rail 13.

Figure 14:
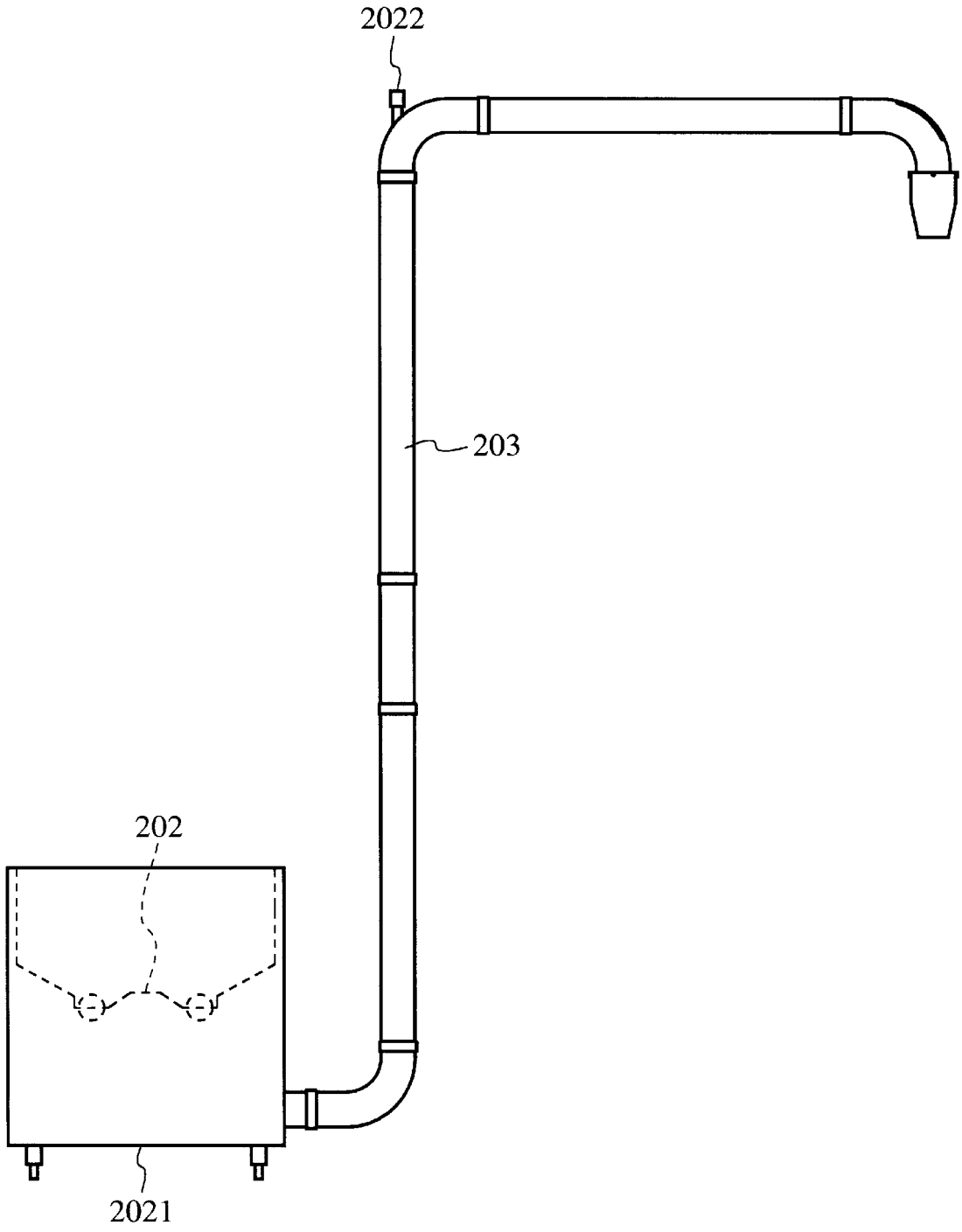
FIG. 14 is a partially cutaway side view of an air pressure operated ball delivery means of the present invention.
Figure 15:
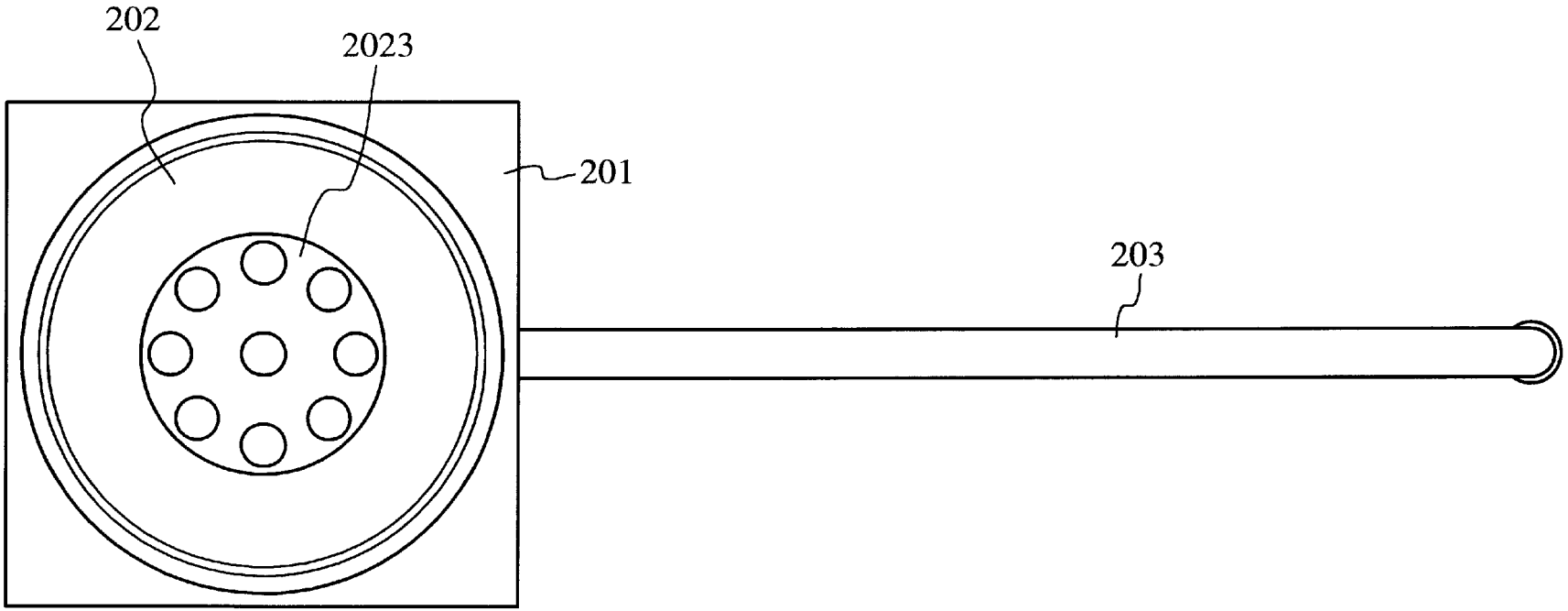
FIG. 15 is a cutaway top view showing a ball delivery means utilizing a rotor mechanism.
Figure 16:
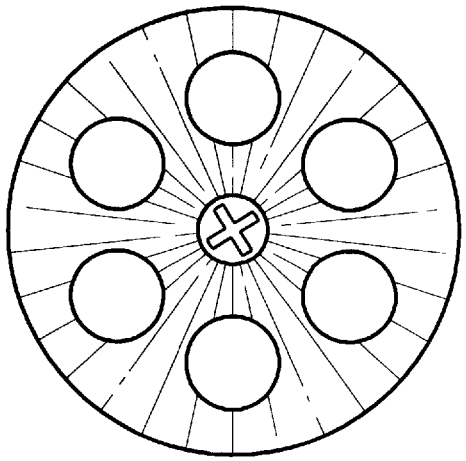
FIG. 16 is a top view of a rotor adapted for baseballs.
Figure 17:
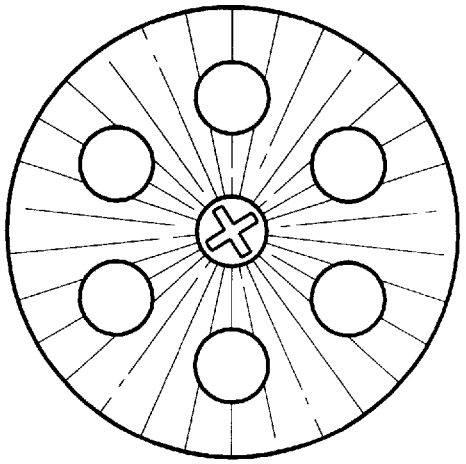
FIG. 17 is a top view of a rotor adapted for tennis balls.
Figure 18:
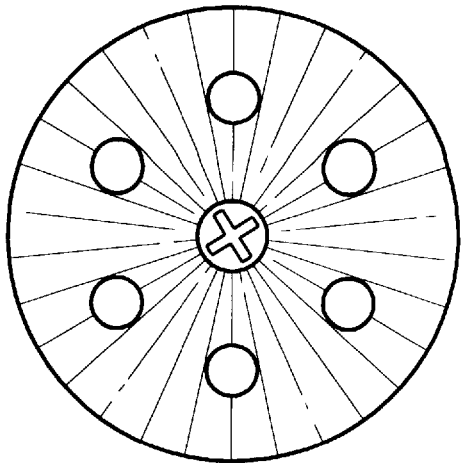
FIG. 18 is a top view of a rotor adapted for golf balls.
Figure 19:
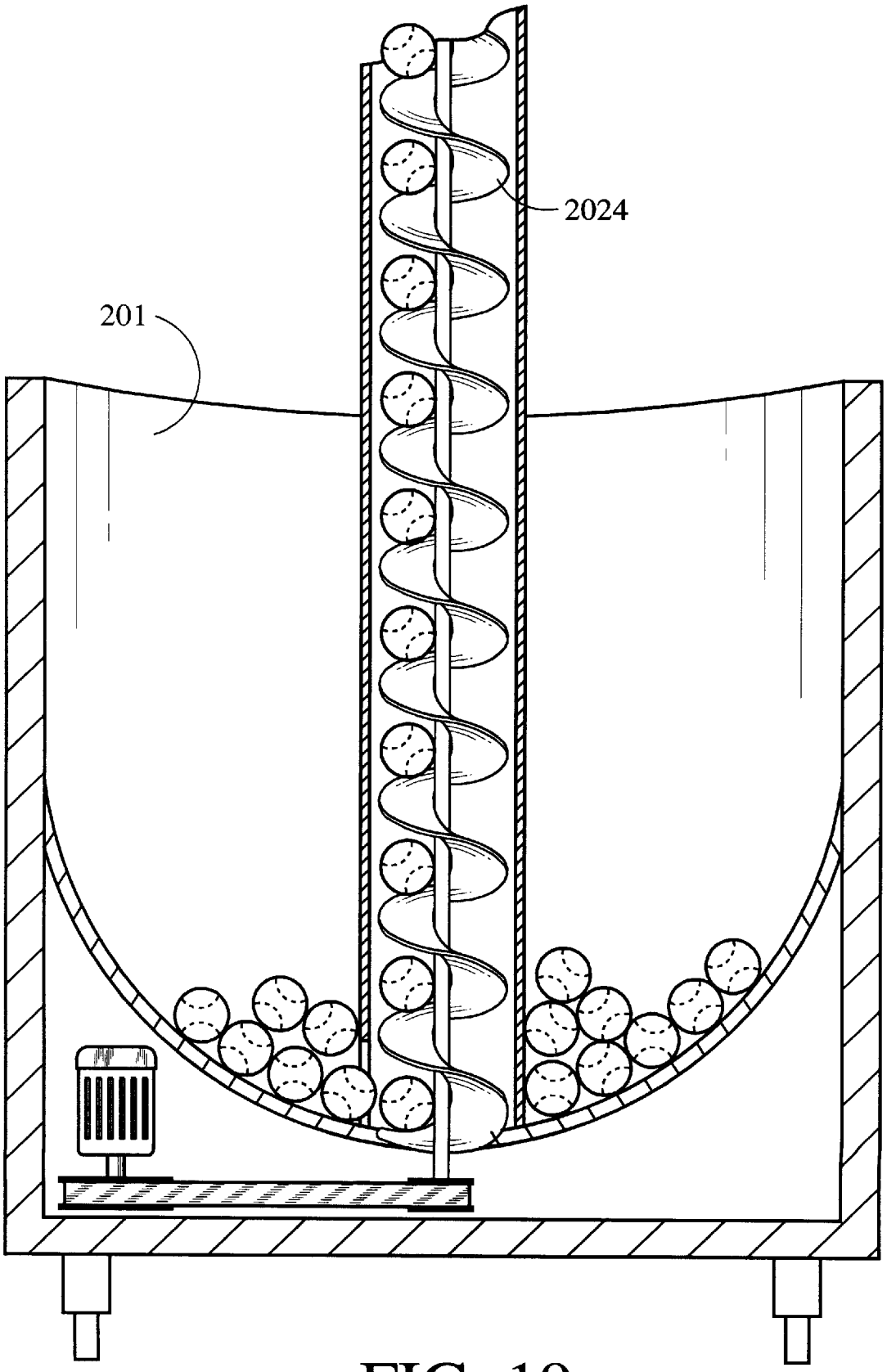
FIG. 19 is a cutaway side view showing a ball delivery means utilizing an auger mechanism.

The ball striking training system of the present invention (when used without the rebound embodiment) will typically include a ball delivery means 20. The ball delivery means 20 comprises a hopper 201, a feeding mechanism 202, and an outlet tube 203. The hopper 201 holds a large plurality of balls, and is in communication with the ball feeding mechanism 202. The ball feeding mechanism 202 withdraws balls one at a time from the hopper 201. There are several known methods in the art for withdrawing the balls from the hopper 201 so that they can be expelled one at a time by the feeding mechanism 202. Some of the methods that have been considered for utilization with the present invention include an air pressure canister 2021 with pressure relief valve 2022 typically used in conjunction with a rotor (FIG. 14), a rotor 2023 (FIGS. 15–18) used in conjunction with a pair of wheels spinning in opposite directions, and an auger 2024 (FIG. 19). When the rotor 2023 is used, a plurality of rotors will be supplied with the system so that the user can switch back and forth from one type of ball to another. A rotor for baseball (FIG. 16) will have larger openings than the rotor for tennis (FIG. 17) which in turn will have larger openings than a rotor for golf (FIG. 18). The rotors are interchangeably placed in the hopper 201 to feed whatever type of balls the user is practicing with at a given time.

The feeding mechanism 202 propels the balls through a vertical rise section 2031 of the outlet tube 203. The length of the vertical rise section 2031 is chosen by the user so that the height of the ball when it is dropped from the outlet tube 203 is such that the rebound of the ball off a floor or the ground takes the ball to the height desired by the user. The vertical rise section 2031 need not be vertical, but must deliver the ball to the height desired by the user.

The balls pass through the vertical rise section 2031 of the outlet tube 203 into a transverse section 2032 that is affixed to the vertical rise section 2031. In the preferred embodiment, the transverse section 2032 is affixed to the vertical rise section 2031 at a slight downward angle so that gravity is used to assist in moving the balls through the transverse section 2032. The ball passes through the transverse section 2032 into a drop section 2033 from which the ball drops into the hitting area.

The inner diameter of an outlet port 2034 of the drop section 2033 is chosen to be equal to that of the subject ball. The diameters of the vertical and transverse sections 2031, 2032 are significantly larger than the balls to allow free passage of the balls through the delivery tube 203. However, the inner diameter of the outlet port 2034 is equal to that of the subject ball. Channeling the balls from the large sections 2031, 2032 of the delivery tube 203 into the outlet port 2034 is accomplished in the preferred embodiment by using a collimator 2035 and a cushioning pad 2036. The cushioning pad is installed in the drop section 2033 at the point where the travel path is directed from a mostly horizontal direction to a vertical direction downward. The collimator 2035 then reduces the diameter of the delivery path, and the cushioning pad 2036 eliminates excessive bounce of the balls within the drop section 2033. This ensures that there is only one available travel path for the ball, so that the ball will always drop from exactly the same position. Variations of the drop path of the ball into the hitting zone caused by variation of the ball's position in the outlet are thus eliminated.

Figure 20:
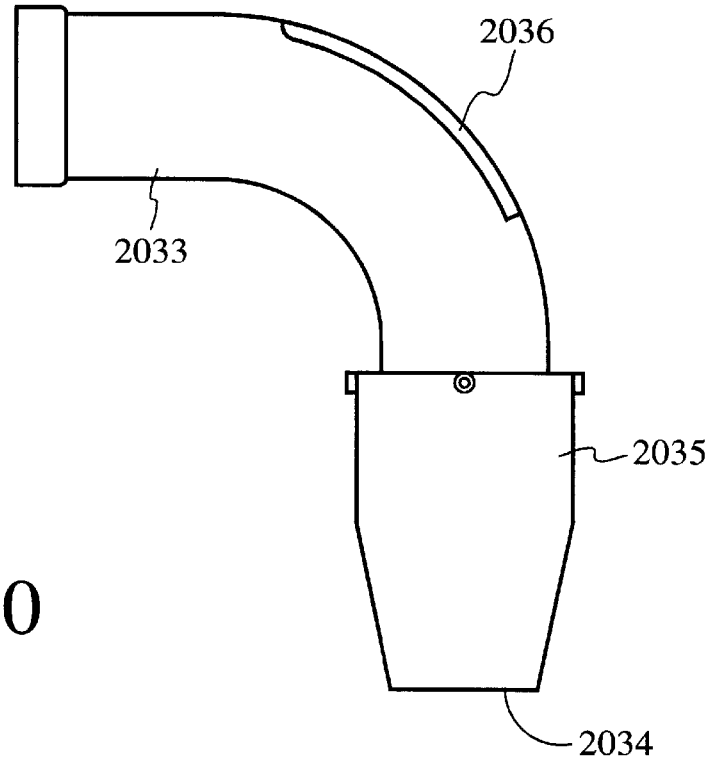
FIG. 20 is a side view of the drop section of the ball delivery means.
Figure 21:
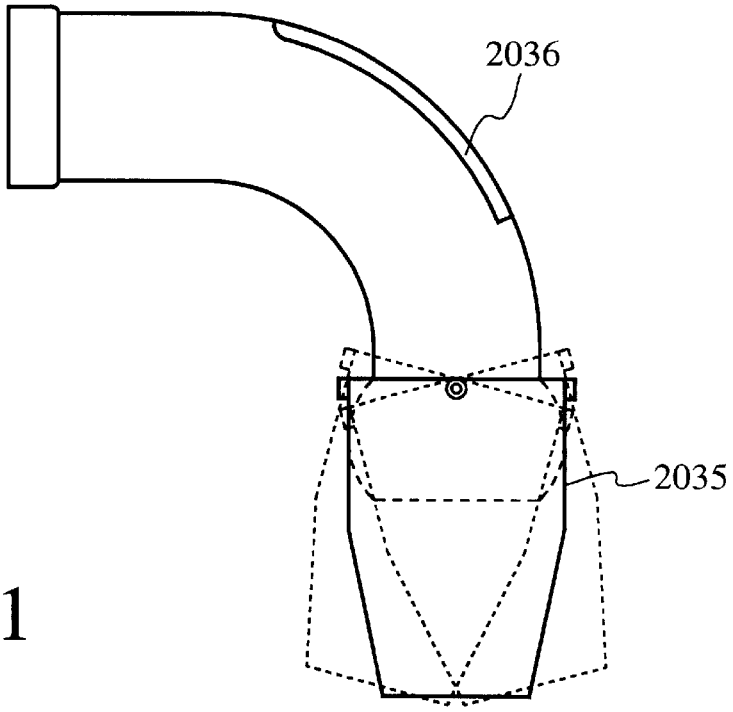
FIG. 21 is a side view of the drop section illustrating the angle adjustment means of the collimator.

The collimator 2035 is adjustably attached to the drop section 2033 so that the user can ensure that the balls will drop straight down from the outlet port 2034. The drop section 2033 and the adjustability of the collimator 2035 is illustrated in FIGS. 20 and 21.

The delivery tube 203 can be formed from any rigid material. At least the terminal end of the tube 203 and the collimator 2035 are made of a clear material so that the user can track the approach of the ball before the ball drops out of outlet port 2034.

Operation of the device is as follows: The user installs the target/collection means 20 in a desired location. Generally, the installation will be either in the user's garage or on a fence at a local park.

The ball delivery means 20 is positioned to deliver balls to a hitting area chosen by the user. Balls are fed one at a time through the delivery tube 203 to the outlet port 2034. The angle adjustable collimator 2035 of the drop section 2033 ensures that the balls drop straight downward, with no horizontal velocity component. This provides the user with a consistent feed of balls that are very easy to strike.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A ball striking training apparatus comprising:

a ball delivery means and a target/retrieval means; wherein said ball delivery means comprises a ball canister, a feeding mechanism, and a delivery tube, said delivery tube comprises a vertical rise section, a transverse section, a drop section, a collimator to reduce the diameter of said delivery tube, and a delivery port that delivers a ball from a position raised above a floor or ground surface, said delivery port delivers the ball directly downward with no horizontal velocity component, such that after the ball strikes the floor or ground, the ball bounces upward to an apex, at which point it is momentarily motionless.

2. The apparatus as claimed in claim 1 wherein:

said drop section includes a cushioning pad to absorb energy from the ball and thereby reduce bounce in a travel path of the ball.

3. The apparatus as claimed in claim 1 wherein:

said feeding mechanism comprises a rotor means.

4. The apparatus as claimed in claim 1 wherein:

said feeding mechanism comprises an auger means.

5. The apparatus as claimed in claim 1 wherein:

said feeding mechanism comprises an air pressure canister so that the ball is projected into said delivery tube by means of air pressure.

6. The apparatus as claimed in claim 1 wherein:

said target/collection means comprises a backdrop with a collection mechanism removably attached thereto.

7. The apparatus as claimed in claim 6 wherein:

said backdrop forms an acute angle relative to the collection mechanism so that the ball is directed downward into said collection mechanism after the ball strikes said backdrop.

8. The apparatus as claimed in claim 6 wherein:

said target/collection means further comprises at least one side panel and a top panel.

9. The apparatus as claimed in claim 6 wherein:

said collection mechanism comprises a collection trough with a gap therein, said collection trough includes a downward angled section on each side of said gap such that balls falling on said collection trough are directed toward said gap, and said collection trough is raised above the floor or ground so that a collection receptacle can be placed in said gap with an upper surface of said collection receptacle even with or below inner edges of said angled sections of said collection trough.

10. The apparatus as claimed in claim 6 wherein:

an extended enclosure comprising an area closed on at least two sides and a top, a back wall of said enclosure comprises said target/collection means; such that a user of said apparatus may stand inside said enclosure to strike balls so that the balls are contained within said enclosure regardless of their path.

11. The apparatus as claimed in claim 1 wherein:

said target/collection means is adapted to be removably attached to garage door rails by means of securing hooks including a main body constructed so as to be removably mountable on the garage door rails.

12. The apparatus as claimed in claim 11 wherein:

said securing hooks are mounted on bearings that roll in the garage door rails, such that said target/collection means is automatically retracted when a garage door mounted on the garage door rails is raised.

13. The apparatus as claimed in claim 1 wherein:

said target/collection means is adapted to be removably attached to a fence by means of securing hooks and a support means including vertical support members and horizontal support members.

14. The apparatus as claimed in claim 1 wherein:

a lower portion of a rear side of said target/collection means is affixed to a support mechanism by a moveable attachment means, a position of said moveable attachment means being varied to control an angle of said rear side of said target/collection means.

15. The apparatus as claimed in claim 1 wherein:

said target/collection means comprises a backdrop.

16. The apparatus as claimed in claim 15 wherein:

said backdrop forms an acute angle relative to a surface upon which said target/collection means is mounted so that the ball is directed downward into said collection mechanism after the ball strikes said backdrop.

17. The apparatus as claimed in claim 15 wherein:

said target/collection means further comprises at least one side panel and a top panel.

18. The apparatus as claimed in claim 15 wherein:

an extended enclosure comprising an area closed on at least two sides and a top, a back wall of said enclosure comprises said target/collection means; such that a user of said apparatus may stand inside said enclosure to strike balls so that the balls are contained within said enclosure regardless of their path.

19. The apparatus as claimed in claim 15 wherein:

said enclosure is formed from a single piece of material, said single piece of material comprises a central portion, at least one side portion, and a rear portion, connecting flaps of said side portions are removably attached to wing elements of said rear portion via removable attaching means, said wing elements of said rear portion are angled so that when said central portion of said enclosure is suspended at a raised position, said rear portion extends downward at a less than 90° angle relative to said central portion such that balls are deflected downward when they strike the rear portion.

* * * * *